US007623808B2

(12) United States Patent
Ozawa et al.

(10) Patent No.: US 7,623,808 B2
(45) Date of Patent: Nov. 24, 2009

(54) IMAGE FORMING DEVICE AND PROCESS CARTRIDGE

(75) Inventors: Toru Ozawa, Saitama (JP); Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 11/269,739

(22) Filed: Nov. 9, 2005

(65) Prior Publication Data

US 2006/0291900 A1 Dec. 28, 2006

(30) Foreign Application Priority Data

Jun. 24, 2005 (JP) ..... 2005-184467

(51) Int. Cl.
*G03G 21/18* (2006.01)

(52) U.S. Cl. ..... 399/111

(58) Field of Classification Search ..... 399/107, 399/110, 111

See application file for complete search history.

(56) References Cited

U.S. PATENT DOCUMENTS 6,029,031 A * 2/2000 Yokomori et al. ..... 399/109
6,480,687 B1 * 11/2002 Kawai et al. ..... 399/111
6,934,489 B2 * 8/2005 Yokomori et al. ..... 399/111
7,127,194 B2 * 10/2006 Hoshi et al. ..... 399/111
7,221,888 B2 * 5/2007 Hymas et al. ..... 399/111
2003/0185587 A1 * 10/2003 Kawai et al. ..... 399/111

FOREIGN PATENT DOCUMENTS

JP 2005-43594 A 2/2005
JP 2007101978 A * 4/2007

* cited by examiner

*Primary Examiner*—David M Gray
*Assistant Examiner*—Andrew V Do
(74) *Attorney, Agent, or Firm*—Sughrue Mion, PLLC

(57) ABSTRACT

An image forming device of the present invention has: a plurality of process cartridges which are provided in a device main body so as to be installable and removable in a lateral direction, and which are disposed in a vertical row; cartridge guides formed at the device main body, and guiding the plurality of process cartridges respectively to installed positions; handles provided at end portions of the plurality of process cartridges respectively, and grasped at times of installing and removing the plurality of process cartridges respectively; and concave portions provided at insert-in portions of the plurality of cartridge guides respectively, and forming spaces for grasping of the handles.

12 Claims, 4 Drawing Sheets

IMAGE FORMING DEVICE AND PROCESS CARTRIDGE

CROSS-REFERENCE TO RELATED APPLICATION

This application claims priority under 35 USC 119 from Japanese Patent Application No. 2005-184467, the disclosure of which is incorporated by reference herein.

BACKGROUND OF THE INVENTION

1. Field of the Invention

The present invention relates to an image forming device which forms images on recording media, and to a process cartridge which is used in the image forming device.

2. Description of the Related Art

As an image forming device which forms images on recording media, there is known an image forming device in which an electrostatic transfer unit, which is in the lateral direction of process cartridges which are disposed in a row vertically in a device main body, is withdrawn such that the process cartridges can be installed and removed in the lateral direction (for example, Japanese Patent Application Laid-Open (JP-A) No. 2005-43594).

In the image forming device of JP-A No. 2005-43594, by providing an interlocking mechanism and a cartridge moving mechanism, interlockingly with the operation of withdrawing the electrostatic transfer unit, a process cartridge which has run out of toner is moved in the lateral direction, and the user can recognize without confusion the process cartridge which should be replaced.

Further, in the image forming device of JP-A No. 2005-43594, because the process cartridge which is to be replaced moves in the lateral direction, the user grasps the central portion of the process cartridge and can replace the process cartridge with one hand.

Moreover, at the time of replacing the process cartridge in the image forming device of JP-A No. 2005-43594, there is no need to consider a space into which the user's fingers can enter. The process cartridges can be disposed such that the distances therebetween are minimum distances, and the device main body can be made compact.

When a user removes a process cartridge by grasping handles which are provided at the both end portions of the process cartridge, the user must stand at the front surface side of the device main body and remove the process cartridge forwardly. However, in the image forming device of JP-A No. 2005-43594, the user can remove the process cartridge by grasping the central portion thereof with one hand. Therefore, the user can remove the process cartridge by extending his/her hand out while standing at a side surface side of the device main body rather than at the front surface side of the device main body, and the degrees of freedom in replacing the process cartridges can be improved.

However, in the image forming device of JP-A No. 2005-43594, because there is the need for an interlocking mechanism and a cartridge moving mechanism, the mechanisms of the device are complex, the number of parts increases, and the cost is high.

SUMMARY OF THE INVENTION

In view of the aforementioned, the present invention relates to facilitating the installation and removal of a process cartridge with a simple structure.

An image forming device relating to a first aspect of the present invention has: plural process cartridges which are provided in a device main body so as to be installable and removable in a lateral direction, and which are disposed in a vertical row; cartridge guides formed at the device main body, and guiding the process cartridges to installed positions; handles provided at end portions of the process cartridges, and grasped at times of installing and removing the process cartridges; and concave portions provided at insert-in portions of the cartridge guides, and forming spaces for grasping of the handles.

What is called "lateral direction" here is the both sides with respect to the front surface of the image forming device, and also includes the front surface side and the rear surface side of the image forming device, and is the lateral direction with respect to the upward direction and the downward direction of the image forming device.

A process cartridge of a second aspect of the present invention has the feature of being used in the image forming device of the first aspect.

Namely, the process cartridge of the second aspect is a process cartridge provided in an image forming device main body so as to be able to be installed and removed in a process cartridge lateral direction, the process cartridge having a handle which is provided at an end portion of the process cartridge and which is grasped at times of installing and removing the process cartridge, wherein the process cartridge can be guided to an installed position by a cartridge guide formed at the image forming device main body, and the handle is graspably disposed within a space formed by a concave portion which is provided at an insert-in portion of the cartridge guide.

BRIEF DESCRIPTION OF THE DRAWINGS

An embodiment of the present invention will be described in detail based on the following figures, wherein.

DETAILED DESCRIPTION OF THE INVENTION

An example of an embodiment relating to an image forming device of the present invention will be described hereinafter on the basis of the drawings.

First, the overall structure of an image forming device 10 of the present embodiment will be described.

Figure 1:
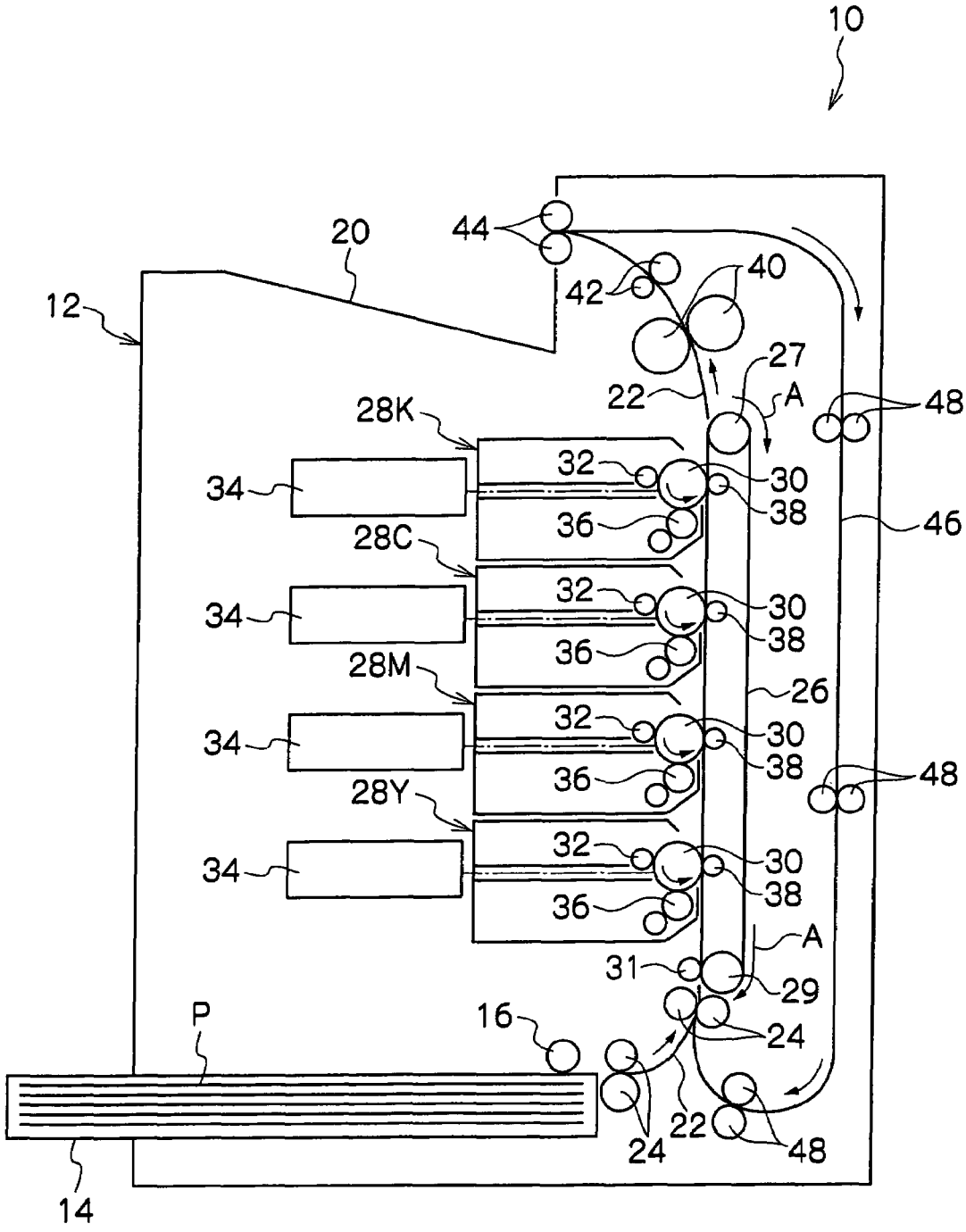
FIG. 1 is a side view of an image forming device relating to an embodiment of the present invention.
Figure 2:
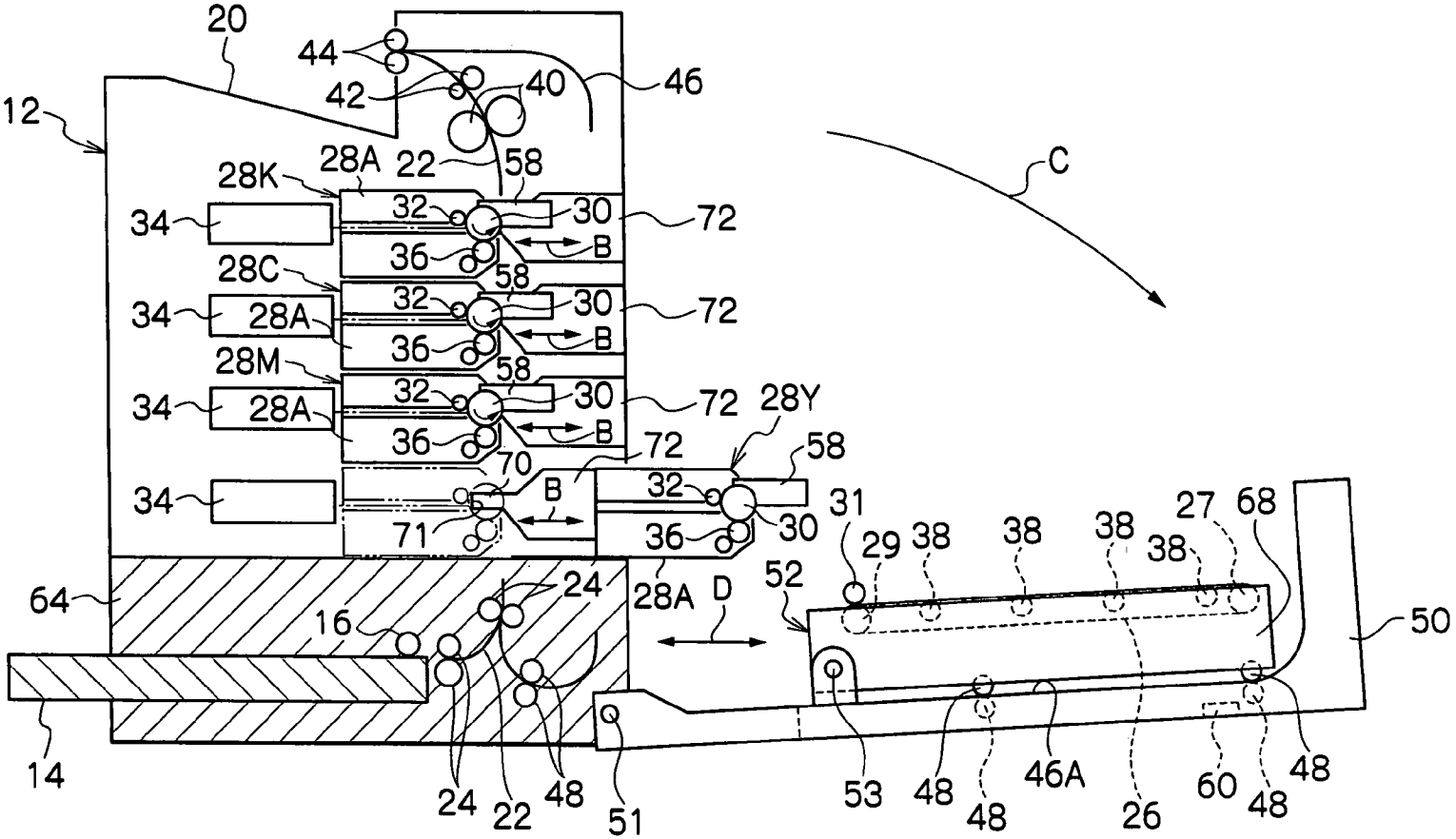
FIG. 2 is a diagram showing a state at a time of removing a process cartridge relating to the embodiment.

As shown in FIGS. 1 and 2, the image forming device 10 of the present embodiment has a device main body 12. A sheet feeding section 64 (the hatched portion in FIG. 2), which supplies sheets P to an image forming section (between a conveying belt 26 and process cartridges 28Y, 28M, 28C, 28K which will be described later), is provided at the lower portion of the device main body 12.

The sheet feeding section 64 is a sheet feeding cassette which is formed in the shape of a box and which can be installed and removed in the directions of arrow D. A sheet tray 14, in which the sheets (recording media) P are stacked in a bunch, is disposed in the sheet feeding section 64.

A feed roller 16 is disposed above the leading end side (the right end side in FIG. 1) of the sheet tray 14. The feed roller 16 press-contacts the leading end side of the top surface of the sheet P, and removes the sheet P from the sheet tray 14.

Further, a first conveying path 22 is provided which extends from the leading end portion of the sheet tray 14 and curves gently and extends substantially vertically upward at the front side of the device (the right side in FIG. 1).

Plural (e.g., two) conveying roller pairs 24, which nip and convey the sheet P, and a conveying belt 26, which is endless and electrostatically attracts and conveys the sheet P on which an image is to be formed, are disposed in that order from the upstream side in the sheet conveying direction along the first conveying path 22. By being disposed along the first conveying path 22, the conveying belt 26 forms a portion of the path surface at one side of the first conveying path 22.

The conveying belt 26 is stretched between a stretch-between roller 27 disposed above and a stretch-between roller 29 disposed below. Due to one of the stretch-between roller 27 and the stretch-between roller 29 being driven and rotated, the conveying belt 26 rotates in the direction of arrow A.

A charging roller 31 is provided adjacent to the conveying belt 26 at the sheet conveying direction upstream side of the conveying belt 26. The charging roller 31 charges the surface of the conveying belt 26, and presses the sheet P, which is electrostatically attracted to the conveying belt 26, against the conveying belt 26.

The plural process cartridges 28Y, 28M, 28C, 28K, which correspond to the respective colors of yellow, magenta, cyan and black, are disposed along the first conveying path 22 in a vertical row in the substantially vertical direction in the device main body 12, in the lateral direction opposing the conveying belt 26 with the first conveying path 22 nipped therebetween.

Each of the process cartridges 28Y, 28M, 28C, 28K has a photosensitive drum (image carrier) 30 which rotates in a predetermined direction (counterclockwise in FIG. 1).

A charging roller 32 which charges the surface of the photosensitive drum 30, an exposure device 34 which exposes the photosensitive drum 30 and forms a latent image on the photosensitive drum 30, and a developing roller 36 which applies color toner to the latent image formed on the photosensitive drum 30 so as to develop the latent image, are provided at the periphery of the photosensitive drum 30 in that order from the upstream side in the direction of rotation of the photosensitive drum 30.

Transfer devices 38, which transfer the toner images formed on the photosensitive drums 30 onto the sheet P at predetermined transfer positions, are provided at the inner peripheral side of the conveying belt 26 in the lateral direction opposing the photosensitive drums 30.

A fixing device 40 which fixes the transferred toner images onto the sheet P, a conveying roller pair 42 which nips and conveys the sheet P, and a discharging roller pair 44 which discharges the sheet P onto a discharge tray 20, are disposed at the sheet conveying direction downstream side of the conveying belt 26.

Further, a second conveying path 46, which is for inverting the sheet P, on whose one surface an image has been formed, and returning the sheet P to the first conveying path 22 again, is provided so as to oppose the first conveying path 22 with the conveying belt 26 therebetween.

Plural (e.g., three) conveying roller pairs 48, which nip and convey the sheet P downwardly, are disposed at the second conveying path 46. At the time of forming images on the both surfaces, the sheet P, on whose one surface an image has been formed, is switched-back by the discharging roller pair 44 and guided to the second conveying path 46, is conveyed downward by the plural conveying roller pairs 48, and is returned to the first conveying path 22.

Next, the image forming operation of forming an image onto the sheet P will be described.

In the image forming device of the present embodiment, when an image is to be formed on one surface of the sheet P, the sheet P which is taken-out from the sheet tray 14 is conveyed upward along the conveying path 22 by the plural conveying roller pairs 24, and is fed to the conveying belt 26. The sheet P which is fed to the conveying belt 26 is pushed against the conveying belt 26 by the charging roller 31, is electrostatically attracted to the charged conveying belt 26, is conveyed upward, and is successively fed to the predetermined transfer positions corresponding to the respective colors of yellow, magenta, cyan, and black.

Toner images of the respective colors, which are formed on the photosensitive drums 30, are transferred by the transfer devices 38 onto the sheet P which is fed to the predetermined transfer positions, such that a full-color image is formed on the sheet P. The sheet P is then conveyed to the fixing device 40, and the transferred toner images are fixed thereon by the fixing device 40. The sheet P is then discharged to the discharge tray 20 by the discharging roller pair 44.

Further, when images are to be formed on the both surfaces of the sheet P, after the toner images are fixed by the fixing device 40 such that an image is formed on one surface, the sheet P is switched-back at the discharging roller pair 44. The sheet P, on whose one surface an image is formed, is thereby inverted and sent into the second conveying path 46. The sheet P is sent into the first conveying path 22 again from the second conveying path 46, and, in the same way as described above, an image is formed on the other surface of the sheet P such that images are formed on the both surfaces thereof. In this way, the series of image forming operations is carried out.

Next, the structure for installing and removing the process cartridges 28Y, 28M, 28C, 28K will be described.

As shown in FIG. 2, the process cartridges 28Y, 28M, 28C, 28K can be installed and removed in the lateral direction (in the directions of arrow B). A handle 58, which is grasped at the time of installation or removal, is provided at each process cartridge 28Y, 28M, 28C, 28K, at the both end portions thereof in a direction orthogonal to the lateral direction in which the process cartridge 28Y, 28M, 28C, 28K is installed or removed. The handle 58 is molded integrally with a case 28A which supports the photosensitive drum 30. Note that the handles 58 are not illustrated in FIG. 1.

Further, the process cartridges 28Y, 28M, 28C, 28K are guided to their installed positions by cartridge guides 70 which are formed at the device main body 12. The process cartridge 28Y, 28M, 28C, 28K, which is guided to its installed position, abuts the terminal end surface 71 of the cartridge guide 70 and is positioned.

A concave portion 72, which forms a space for the grasping of the handle 58, is provided at the insert-in portion of the cartridge guide 70.

Further, as shown in FIG. 2, a cover 50 is provided at the lower portion of the sheet feeding section 64. The cover 50 is L-shaped and rotatably supported by a supporting shaft 51. Due to the cover 50 being rotated and tilted from the device main body 12 side toward the outer side of the device (i.e., in the direction of arrow C in FIG. 2), the cover 50 can open the lateral direction sides of the process cartridges 28Y, 28M, 28C, 28K. The process cartridges 28Y, 28M, 28C, 28K can be installed and removed from the lateral sides of the process cartridges 28Y, 28M, 28C, 28K which are opened by the cover 50.

At the inner surface side of the cover 50, one path surface 46A of the second conveying path 46 is formed, and ones of the conveying roller pairs 48 are provided. On the other hand, a handle 60 which is grasped at the time of rotating the cover 50 is provided at the outer surface side of the cover 50.

Figure 3:
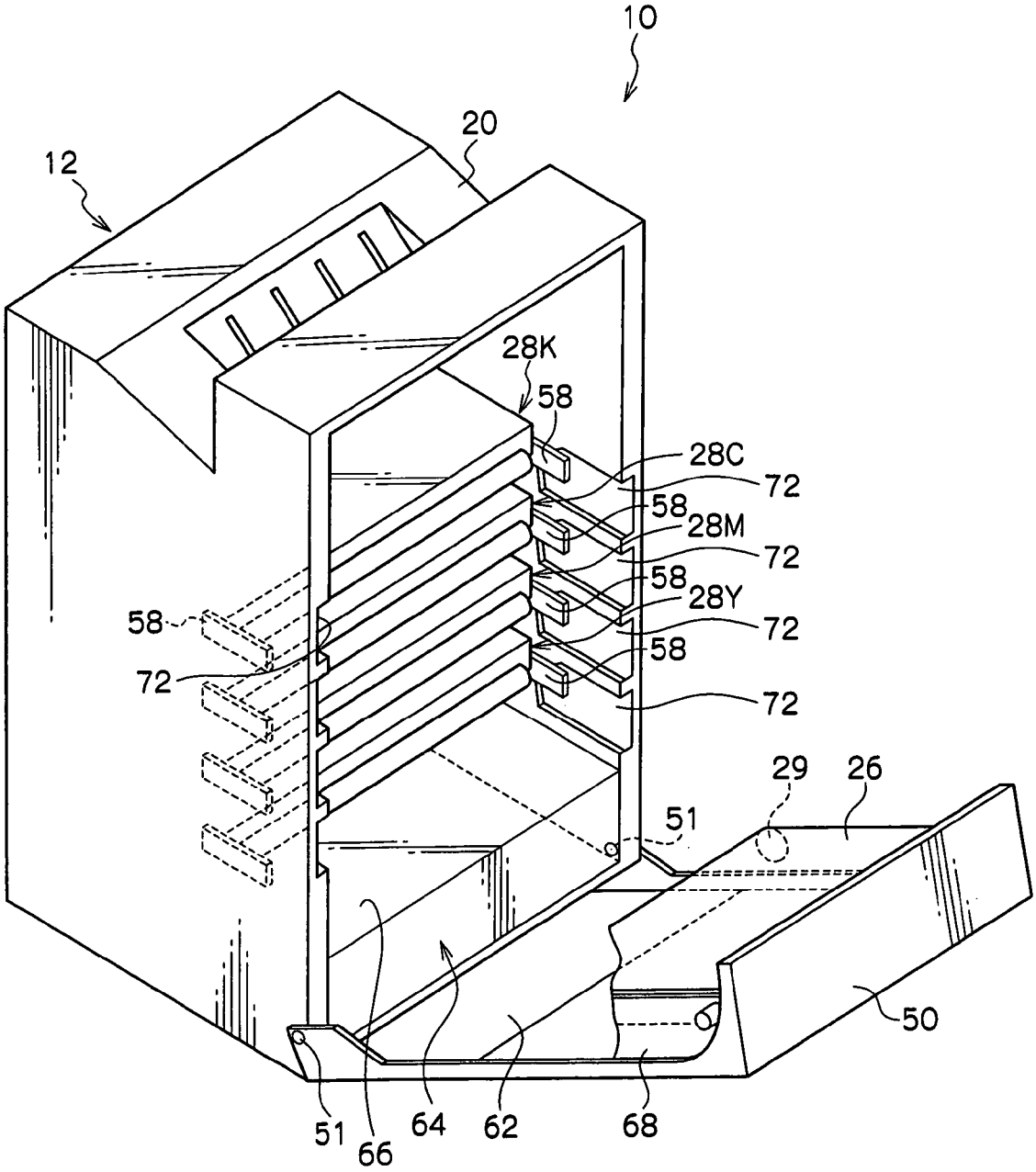
FIG. 3 is a perspective view of the image forming device relating to the embodiment.

As shown in FIG. 3, an opening portion 62 is provided at the lower portion of the cover 50 such that the cover 50 is formed in the shape of a gate. The sheet feeding section 64 (the hatched portion in FIG. 2) which is a sheet feeding cassette can be installed and removed in the directions of arrow D from this opening portion 62.

A guide portion 66 is formed at the top surface of the sheet feeding section 64. The lowermost process cartridge 28Y can be placed on the guide portion 66, and the guide portion 66 guides the process cartridge 28Y placed thereon to its installed position in the device main body 12.

A conveying belt unit 52, which includes the conveying belt 26, is mounted by a supporting shaft 53 at the upper side of the opening portion 62 of the cover 50, and rotates integrally with the cover 50.

The conveying belt 26 is provided at the conveying belt unit 52 at the side thereof facing the process cartridges 28Y, 28M, 28C, 28K (i.e., the upper side in FIG. 2). At the side of the conveying belt unit 52 which side opposes the cover 50 (i.e., the lower side in FIG. 2), another path surface 46B of the second conveying path 46 is formed, and the others of the conveying roller pairs 48 are provided.

The others of the conveying roller pairs 48, and the stretch-between rollers 27, 29 between which the conveying belt 26 is stretched, are rotatably supported at a pair of side plates 68 of the conveying belt unit 52 which are provided at the both axial direction end portions of these rollers. Further, the charging roller 31 is provided integrally with the conveying belt 26, and rotates integrally with the cover 50.

When the cover 50 is rotated and opens the lateral direction sides of the process cartridges 28Y, 28M, 28C, 28K, the charging roller 31 and the conveying belt 26 move to positions in the lateral direction of the sheet supplying section 64.

Figure 4:
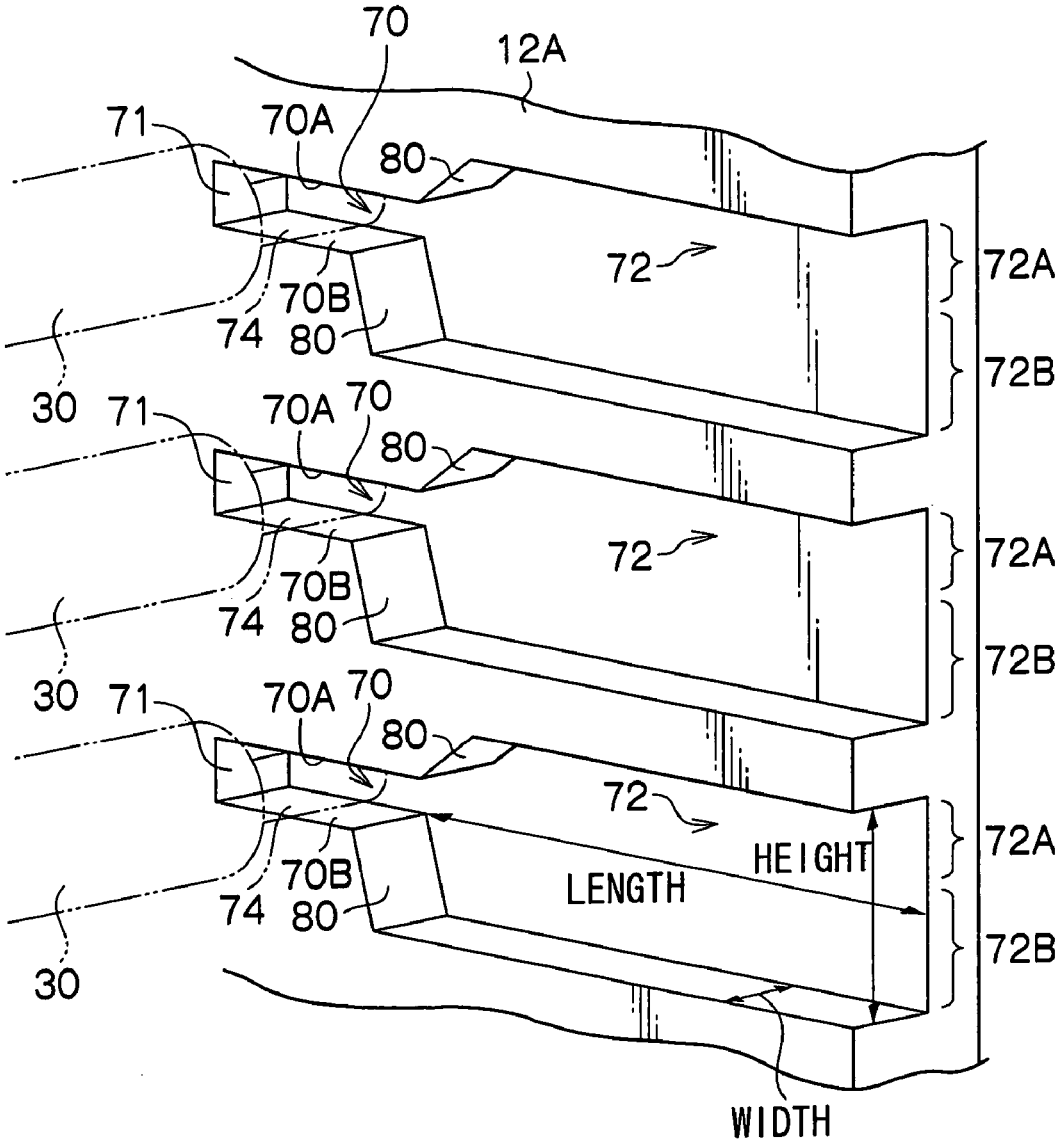
FIG. 4 is a diagram showing concave portions relating to the embodiment.

Next, the configurations of the cartridge guides 70, the configurations of the concave portions 72, and the like will be described on the basis of FIG. 4.

A guide surface 70A at the upper side of the cartridge guide 70 is formed to be longer than a guide surface 70B at the lower side, toward the concave portion 72. The cartridge guide 70 is formed integrally with a frame 12A of the device main body 12.

At the concave portion 72 which is provided at the insert-in portion of the cartridge guide 70, a lower side region 72B is larger than an upper side region 72A, with respect to the cartridge guide 70. Further, the backward depth (inside length) of the concave portion 72 is larger at the lower side region 72B than at the upper side region 72A.

The regions of the process cartridges 28Y, 28M, 28C, 28K, which regions are guided by the cartridge guides 70, are convex portions 74 which are provided coaxially with the photosensitive drums 30 of the process cartridges 28Y, 28M, 28C, 28K.

The concave portion 72 has an inclined surface 80 which inclines toward the cartridge guide 70. The cross-section of the concave portion 72 is structured in a taper shape which tapers toward the cartridge guide 70.

The configurations of the concave portions 72 may be structured so as to differ in accordance with the heights of the installed positions of the process cartridges 28Y, 28M, 28C, 28K. As a concrete example of this structure, a structure can be used in which any of the height from the bottom surface to the top surface, the recessed depth in the lateral direction, and the backward depth, is greater at the concave portions 72B formed at the lower side region than at the concave portions 72A formed at the upper side region.

In this way, the operability of the process cartridges at the lower side at which operability is inconvenient (the process cartridge 28Y in particular) can be improved.

The handles 58 may be structured such that the shapes thereof differ in accordance with the sizes of the concave portions 72. As a concrete example of this structure, the handle 58 disposed at the larger concave portion 72 may be longer than the handle 58 disposed at the smaller concave portion 72.

In this way, even if the sizes of the concave portions 72 are different, the operability in installing and removing the process cartridges 28Y, 28M, 28C, 28K can be made to be uniform.

Next, operation of the above-described embodiment will be described.

In the above-described embodiment, when the process cartridge 28Y, 28M, 28C, 28K must be replaced, first, due to the user grasping the handle 60 and rotating the cover 50, the user withdraws the conveying belt unit 52 and opens the lateral direction sides of the process cartridges 28Y, 28M, 28C, 28K.

The user inserts his/her hand from the opened lateral direction side of the process cartridge 28Y, 28M, 28C, 28K into the concave portion 72 forming the space for grasping the handle 58, grasps the handle 58 of the process cartridge 28Y, 28M, 28C, 28K, removes the process cartridge 28Y, 28M, 28C, 28K, and can install a new process cartridge.

In this way, in the present embodiment, because the concave portion 72 which forms the space for grasping the handle 58 is provided, installation and removal of the process cartridges 28Y, 28M, 28C, 28K are easy even in a case in which the process cartridges 28Y, 28M, 28C, 28K are installed deep back in the device main body 12.

Accordingly, in accordance with the structure of the present embodiment, the installation and removal of the process cartridges 28Y, 28M, 28C, 28K are facilitated by the simple structure of providing the concave portions 72, without providing a moving mechanism for moving the process cartridges 28Y, 28M, 28C, 28K.

Further, in the present embodiment, the guide surface 70A at the upper side of the cartridge guide 70 is formed to be longer than the lower side guide surface 70B, toward the concave portion 72. Therefore, at the time of installing the process cartridge 28Y, 28M, 28C, 28K, the process cartridge 28Y, 28M, 28C, 28K can be inserted while making the convex portion 74 move along the upper side guide surface 70A, and the operability of the installation and removal is good.

In the present embodiment, at the concave portion 72 provided at the insert-in portion of the cartridge guide 70, the lower side region 72B is larger than the upper side region 72A, with respect to the cartridge guide 70. Moreover, at the lower side region 72B, the backward depth of the concave portion 72 is formed to be greater than at the upper side region 72A.

Therefore, at the time when the user grasps the handle 58 with his/her thumb and index finger, the back of the hand, the middle finger, ring finger, and little finger can easily fit into the concave portion 72, and the process cartridge 28Y, 28M, 28C, 28K can be easily installed and removed.

Moreover, in the present embodiment, the guide portion 66, on which the lowermost process cartridge 28Y can be placed and which guides the placed process cartridge 28Y to its installed position in the device main body 12, is formed at the top surface of the sheet feeding section 64. Therefore, even the lowermost process cartridge 28Y, whose position of being installed in the device main body 12 is difficult to visually confirm, can be installed and removed easily.

Because the cartridge guides 70 are formed integrally with the frame 12A of the device main body 12 in the present embodiment, the number of parts can be reduced.

Further, in the present embodiment, the process cartridges 28Y, 28M, 28C, 28K are positioned by the convex portions 74 which are provided coaxially with the photosensitive drums 30. Therefore, the photosensitive drums 30 of the process cartridges 28Y, 28M, 28C, 28K can be positioned correctly in the device main body 12.

The concave portions 72 have inclined surfaces 80 which are inclined toward the cartridge guides 70 in the present embodiment. Therefore, when a user inserts his/her hand into the concave portion 72, his/her hand does not hit an angular portion.

In the present embodiment, because the handle 58 is molded integrally with the case 28A which supports the photosensitive drum 30, the rigidity of the handle 58 is high, and the handle 58 is sturdy when the process cartridge 28Y, 28M, 28C, 28K is installed in the device main body 12.

The cross-sectional configuration of the concave portion 72 is described as being taper-shaped in the above-described embodiment. However, the concave portion of the present invention is not limited to the same. For example, the cross-section may be rectangular, and it suffices for the concave portion to be a concave portion which forms a space for grasping the handle.

Note that, in the image forming device of the present invention, the handle of the process cartridge can be grasped by the user inserting his/her hand into the concave portion which forms a space at the insert-in portion of the cartridge guide.

Therefore, even in a case such as in which the process cartridges are installed deep back in the device main body, installation and removal of the process cartridges are easy. In this way, in accordance with the above-described structure, there is no need to provide a moving mechanism such as that disclosed in JP-A No. 2005-43594 for moving the process cartridges, and installation and removal of the process cartridges are made easy by the simple structure of providing the concave portions.

Further, in the above-described structure, an upper side guide surface of the cartridge guide may be formed to be longer than a lower side guide surface, toward the concave portion.

In the above-described structure, a lower side of the concave portion may be larger than an upper side of the concave portion, with respect to the cartridge guide.

In the above-described structure, a backward depth of a lower side of the concave portion may be larger than a backward depth of an upper side of the concave portion.

In the above-described structure, there may be provided a guide portion on which a lowermost process cartridge can be placed, and which guides the placed process cartridge to the installed position.

In the above-described structure, the cartridge guides may be formed integrally with a frame of the device main body.

In the above-described structure, regions of the process cartridges, which regions are guided by the cartridge guides, may be convex portions which are provided coaxially with image carriers which are provided at the process cartridges.

In the above-described structure, configurations of the concave portions may differ in accordance with the installed positions of the plural process cartridges.

In the above-described structure, the concave portion which is formed at a lower side may be larger than the concave portion which is formed at an upper side.

In the above-described structure, at least one of a height from a bottom surface to a top surface, a recessed depth in a lateral direction, and a backward depth of the concave portion may be a large value.

In the above-described structure, configurations of the handles may differ in accordance with sizes of the concave portions.

In the above-described structure, the handle disposed at the concave portion which is large may be longer than the handle disposed at the concave portion which is small.

In the above-described structure, the concave portions may have inclined surfaces which are inclined toward the cartridge guides.

Further, in the process cartridge of the present invention, the handle may be molded integrally with a case which supports an image carrier.

In the above-described structure, a length of the handle may differ in accordance with a position at which the handle is disposed.

Because the present invention has the above-described structure, installation and removal of the process cartridge can be made to be easy with a simple structure in consideration of the aforementioned.

What is claimed is:

1. An image forming device comprising:

a plurality of process cartridges which are provided in a device main body so as to be installable and removable in a lateral direction, and which are disposed in a vertical row;

cartridge guides formed as an integral part of the device main body, and guiding the plurality of process cartridges respectively to installed positions;

handles provided at end portions of the plurality of process cartridges respectively, and grasped at times of installing and removing the plurality of process cartridges respectively; and concave portions, formed from the device main body and provided at insert-in portions of the plurality of cartridge guides respectively, and forming spaces for grasping of the handles, wherein a lower side of the concave portion is larger than an upper side of the concave portion, with respect to the cartridge guide.

2. The image forming device of claim 1, wherein an upper side guide surface of the cartridge guide is formed to be longer than a lower side guide surface, toward the concave portion.

3. The image forming device of claim 1, wherein a backward depth of a lower side of the concave portion is larger than a backward depth of an upper side of the concave portion.

4. The image forming device of claim 1, further comprising a guide portion on which a lowermost process cartridge among the plurality of process cartridges can be placed, and which guides the process cartridge which is placed thereon to the installed position.

5. The image forming device of claim 1, wherein the cartridge guides are formed at a frame of the device main body.

6. The image forming device of claim 1, wherein regions of the process cartridges, which regions are guided by the cartridge guides, are convex portions which are provided coaxially with image carriers which are provided at the process cartridges.

7. The image forming device of claim 1, wherein configurations of the concave portions differ in accordance with the installed positions of the plurality of process cartridges.

8. The image forming device of claim 7, wherein the concave portion which is formed at a lower side is larger than the concave portion which is formed at an upper side.

9. The image forming device of claim 8, wherein at least one of a height from a bottom surface to a top surface, a recessed depth in a lateral direction, and a backward depth of the concave portion which is formed at the lower side is larger than that of the concave portion which is formed at the upper side.

10. The image forming device of claim 1, wherein configurations of the handles differ in accordance with sizes of the concave portions.

11. The image forming device of claim 1, wherein the concave portions have inclined surfaces which are inclined toward the cartridge guides.

12. The image forming device of claim 1, wherein said concave portions are provided so as to oppose the handles of the process cartridges installed in the device main body when the device main body is opened by opening a cover of the device main body.

* * * * *